US006009573A

United States Patent [19]

Thibault

[11] Patent Number: 6,009,573

[45] Date of Patent: Jan. 4, 2000

[54] SAFETY DIFFUSER FOR POOL SUCTION INLET

[76] Inventor: Arnold F. Thibault, P.O. Box 121510, Clermont, Fla. 34712

[21] Appl. No.: 09/002,162

[22] Filed: Dec. 31, 1997

[51] Int. Cl.[7] ..... E04H 4/00

[52] U.S. Cl. ..... 4/507; 4/504; 4/496

[58] Field of Search ..... 4/507, 504, 496, 4/541.6, 490, 509, 653; 210/416.1, 416.2, 459, 460, 461, 462, 463

[56] References Cited

U.S. PATENT DOCUMENTS

| | | | |
|---|---|---|---|
| 3,160,588 | 12/1964 | Alarie | 210/463 |
| 3,596,295 | 8/1971 | Wilson . | |
| 4,035,299 | 7/1977 | Vroeginday . | |
| 4,346,484 | 8/1982 | Martin | 4/507 |
| 4,351,077 | 9/1982 | Hofmann . | |
| 4,642,833 | 2/1987 | Stolz et al. . | |
| 4,742,593 | 5/1988 | Kallenbach . | |
| 4,973,403 | 11/1990 | Kozey | 210/460 |
| 5,014,382 | 5/1991 | Kallenbach . | |
| 5,499,406 | 3/1996 | Chalberg et al. . | |
| 5,536,397 | 7/1996 | D'Offay . | |
| 5,570,481 | 11/1996 | Mathis et al. . | |
| 5,665,248 | 9/1997 | McKiddy, II | 4/496 |
| 5,734,999 | 4/1998 | Nicholas | 4/507 |

FOREIGN PATENT DOCUMENTS

| | | |
|---|---|---|
| 693-775 | 9/1964 | Canada . |
| 1-140-708 | 2/1983 | Canada . |
| 1-254-105 | 5/1989 | Canada . |
| 1-256-262 | 6/1989 | Canada . |

*Primary Examiner*—David J. Walczak
*Attorney, Agent, or Firm*—Fleshner & Kim; Stuart I. Smith

[57] ABSTRACT

A safety diffuser for use with an underwater suction inlet of a pool or spa eliminates the danger associated with a suction inlet on a side of a pool or spa created by the strong suction produced by the pool pump. By strategically placing holes in a tubular portion of the device, blockage of all the holes by a user of the pool or spa is prevented. As a result, the danger of a user of the pool or spa being drawn to and held against the device or the suction inlet is reduced.

18 Claims, 4 Drawing Sheets

SAFETY DIFFUSER FOR POOL SUCTION INLET

BACKGROUND OF THE INVENTION

1. Field of Invention

The present invention relates to a diffuser for insertion into a suction inlet in a side of a swimming pool or spa.

2. Description of Related Art

A popular method for cleaning swimming pools and spas involves the use of a device which automatically moves throughout the pool or spa cleaning the bottom and sides of the pool or spa as it moves. Many popular forms of this pool cleaning device employ water suction as a means for propulsion. The water suction is usually provided by the main pool water pump which is used to circulate the pool water through a filter.

The pool cleaning device is usually connected to the pump by a flexible hose, which in turn is connected to a water suction inlet in the side of the pool and below the surface of the water. The suction created by the pump draws water into the pool cleaning device, through the flexible hose, into the water suction inlet and through piping to the pump.

As pool pumps operate at high pumping rates, moving great volumes of water in a short period of time, the suction created at the water suction inlet can be very strong.

The pool cleaning device is usually left connected to the water suction inlet whenever the pool is not in use and operates whenever the pool pump operates. To avoid possible entanglement of a swimmer with the pool cleaning device and/or flexible hose, the pool cleaning device and flexible hose are usually removed from the pool and disconnected from the water suction inlet whenever the pool is used. However, whenever the pool pump operates with the flexible hose detached from the water suction inlet, the strong suction created by the pool pump at the water suction inlet presents a safety hazard to swimmers. As the water suction inlet is traditionally a hole in the side of the pool of approximately one to two inches in diameter, the high flow rate of the pool pump creates a very strong suction at the water suction inlet.

Swimmers, especially small children, have been injured by being pulled toward and held against the water suction inlet due to the powerful suction created by the pool pump. Because the water suction inlet is generally a hole relatively flush with the side of the pool, an area of skin of a swimmer larger than the water suction inlet can create a water-tight seal with the water suction inlet resulting in a very strong vacuum being created within the pipe between the water suction inlet and the pool pump. This vacuum can make it very difficult, or even impossible, for the swimmer to pull away from the water suction inlet until the pool pump is turned off. The resulting injuries can include severe bruises and death due to drowning.

It is possible to avoid the above-described danger by turning off the pool pump prior to removal of the flexible hose from the water suction inlet. However, the controls for the pool pump are often located at a remote location from the pool itself and, therefore, swimmers often neglect to turn off the pump prior to swimming. In addition, as all swimmers are not familiar with the operation of pool pump controls, owners of pools are often reluctant to allow swimmers to operate pool pump controls.

SUMMARY OF THE INVENTION

To solve the above-described pool safety problem, Applicant has invented a suction dispersion device to be inserted into an underwater suction inlet of a pool or spa. The device includes a tubular body having a first tubular portion and a second tubular portion. The first tubular portion has a sealing mechanism for forming a substantially water-tight seal with the suction inlet and the second tubular portion has a submersible length with a perforated periphery and a perforated end. The perforations on the periphery and the end of the submersible length of the second tubular portion disperse the suction force created by the pool pump along the submersible length of the second tubular portion.

By perforating the periphery and the end of the second tubular portion, the danger of a swimmer being drawn to and held against the suction inlet by suction force is eliminated. This is because it is very difficult, if not impossible, to cover all of the perforations on the periphery and the end of the submersible length at one time. As a result, when a swimmer comes in contact with the device, only a portion of the perforations are covered and the suction force can draw water through the remaining perforations which are not covered by the swimmer. Since less than all of the perforations are covered at any one time by a swimmer coming in contact with the device, the suction force at the perforations covered by the swimmer is insufficient to injure the swimmer or prevent the swimmer from pulling away from the device.

DETAILED DESCRIPTION OF PREFERRED EMBODIMENTS

Preferred embodiments of the invention will now be explained with reference to the attached figures.

Figure 1:
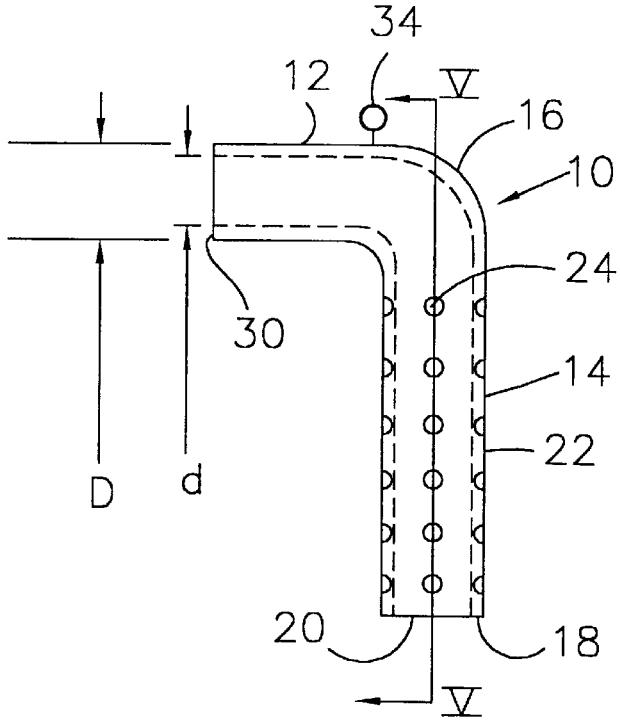
FIG. 1 is a side view of one embodiment of the present invention.
Figure 2:
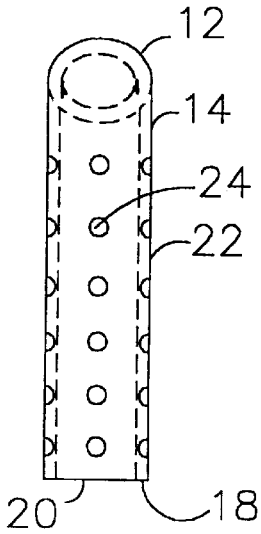
FIG. 2 is a front view of the device shown in FIG. 1.
Figure 4:
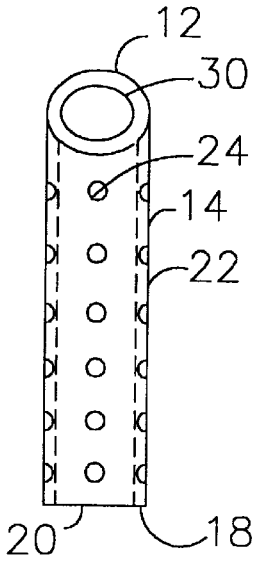
FIG. 4 is a rear view of the device shown in FIG. 1.
Figure 3:
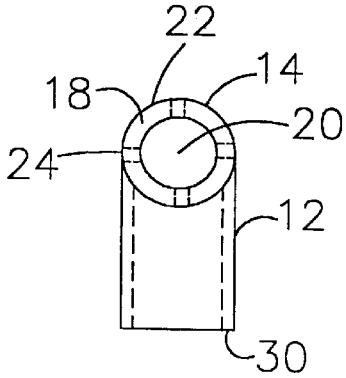
FIG. 3 is a bottom view of the device shown in FIG. 1.
Figure 5:
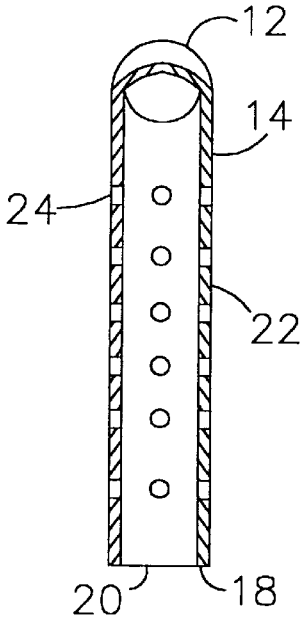
FIG. 5 is a sectional view along section line V—V of FIG. 1.
Figure 9:
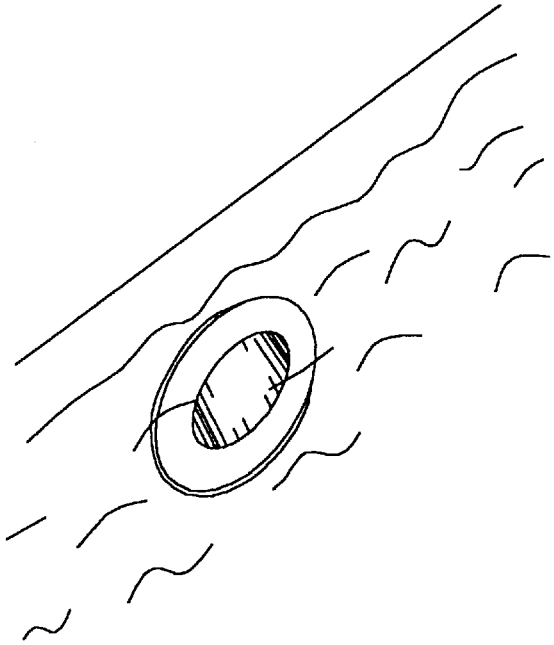
FIG. 9 is a perspective view of an underwater suction inlet in the side of a pool.
Figure 10:
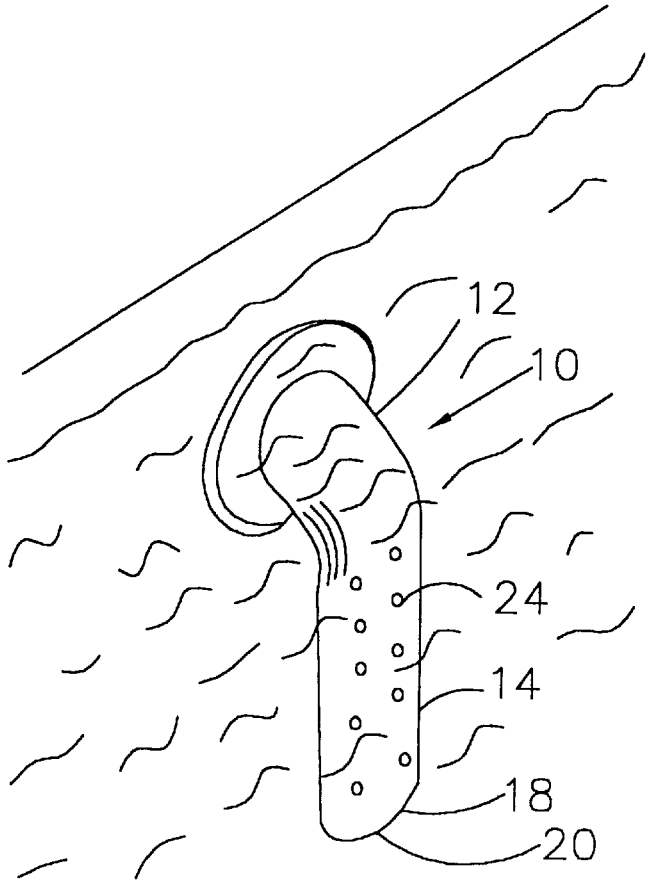
FIG. 10 is a perspective view of the device shown in FIG. 1 inserted into the underwater suction inlet of FIG. 9.

FIG. 1 shows a side view of a first embodiment of the invention wherein the suction dispersion device includes a tubular body 10 having a first tubular portion 12 and a second tubular portion 14. The first tubular portion 12 and the second tubular portion 14 are connected by a connector portion 16 which can be a 90° elbow in a preferred embodiment. The first tubular portion 12 is configured so as to fit into an underwater suction inlet of a pool or spa. As conventional suction inlets are usually round in shape (as shown in FIG. 9), in the embodiment shown in FIGS. 1–5, the first tubular portion 12 is a round tube. The outside diameter D of the first tubular portion 12 is slightly smaller than the inside diameter of the suction inlet so that the first tubular portion 12 slides snugly into the suction inlet and is held in place by frictional forces between the outer surface of the first tubular portion 12 and the inner surface of the suction inlet (as shown in FIG. 10).

The second tubular portion 14 has an end 18. The end 18 of the second tubular portion 14 is perforated with at least one end hole 20 so as to allow the flow of water into the end hole 20, through the second tubular portion 14 and into the suction inlet. The second tubular portion 14 has a periphery surface 22 which is perforated by at least one periphery hole 24. The at least one periphery hole 24 allows water to flow into and through the second tubular portion 14 and into the suction inlet.

The number and location of periphery holes 24 is set so that it is very difficult for a user of the pool to block all periphery holes 24 and the end hole 20 at one time. For example, multiple periphery holes 24 can be provided such that a first hole and a second hole are spaced apart by at least 2½ inches, preferably at least 3 inches and more preferably at least 4 inches. As another example, a first one of the periphery holes 24 can be located on a first plane and a second one of the periphery holes 24 can be located on a second plate different from the first plane. By locating the first and second holes on different planes (for example planes perpendicular to one another), the danger of a substantially planar body part (such as a person's back) being held against the suction dispersion device is reduced or eliminated. Although this embodiment has been described with only one end hole 20, multiple end holes 20 can be provided. By positioning the periphery holes 24 and the end holes 20 as described above, the danger of a person using the pool being drawn to and held against the device is avoided. As a result, the danger associated with an open water suction inlet is eliminated when the device is inserted into the water suction inlet.

While the embodiment of the invention shown in FIGS. 1–5 is made from a single piece of bent tubing, the device could also be made from several pieces of straight tubing connected by, for example, 90° elbow tubing. In addition, shapes other than round tubing can be employed as the second tubular portion 14. Also, the first tubular portion 12 can be configured in any shape that will be accepted by the suction inlet.

In the embodiment shown in FIGS. 1–5, the end hole 20 has a diameter equal to the inside diameter d of the first tubular portion 12 because the device is made from a uniform diameter piece of tubing.

Figure 6:
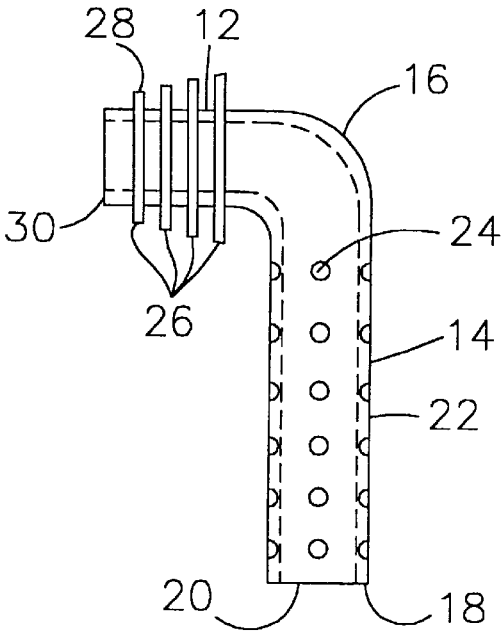
FIG. 6 is a side view of a second embodiment of the present invention.
Figure 7:
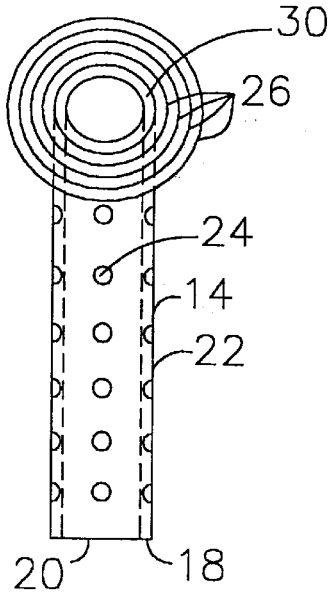
FIG. 7 is a rear view of the embodiment shown in FIG. 6.

In another embodiment of the invention (FIG. 6), the first tubular portion 12 includes a plurality of flexible fins 26 protruding radially from the first tubular portion 12. The fins 26 are preferably of different sizes and arranged with the smallest fin 28 closest to the end 30 of the first tubular portion 12, as shown in FIG. 6. The fins 26 allow the universal use of the device with suction inlet holes of varying sizes. The fins 26 also allow the formation of a substantially water-tight seal even when irregularities exist in the size and/or shape of the suction inlet or the first tubular portion 12. Adapters having such fins are commercially available.

Figure 8:
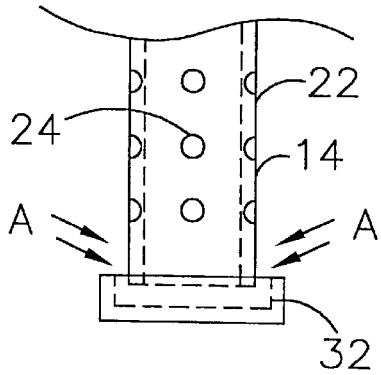
FIG. 8 is a partial view of another embodiment of the invention.

In another embodiment of the invention (FIG. 8), a cap 32 covers the end 18 of the second tubular portion 14. The cap 32 is sufficiently larger than the end 18 so that water can flow around the cap and into the end hole 20 of the second tubular portion 14, as shown by arrows A in FIG. 8. An attachment portion 34 (FIG. 1) also can be fitted to the body 10 of the invention to allow attachment of the invention to the pool by a string, or the like, so as to facilitate retrieval of the invention if it is dropped in the pool.

Figure 11:
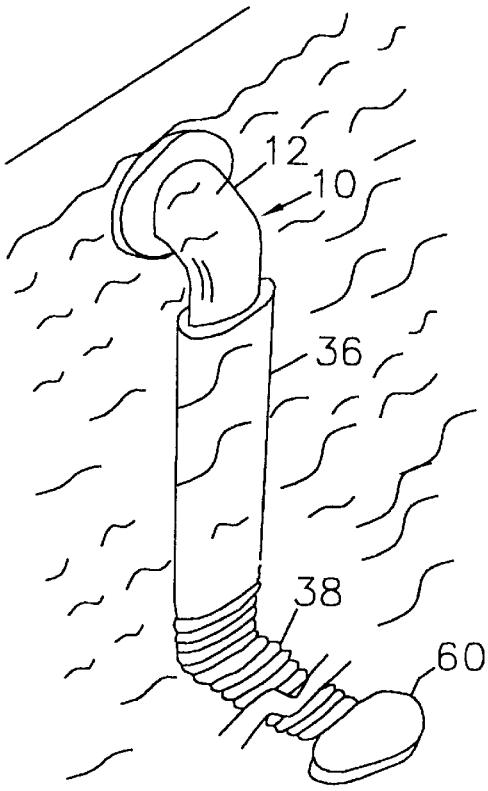
FIG. 11 is a perspective view of an embodiment of the invention which includes a connection device.

In other embodiments, the suction dispersion device can be used with the flexible hose of the mobile pool cleaner. For example, (FIG. 11) if the suction dispersion device were installed in the suction inlet, the flexible hose could be attached to the first and/or second tubular portions 12, 14 of the tubular body 10 by a connection device 36 to cover the end hole 20 and periphery holes 24. This way, the suction is developed in the flexible hose through the end hole 20 and/or periphery holes 24. When the pool cleaner 60 is removed from the pool, the flexible hose can be disengaged from the suction dispenser device by releasing the connection device 36, thereby exposing the end hole 20 and periphery holes 24 and dispersing the suction force along the submerged length of the second tubular portion.

Figure 12:
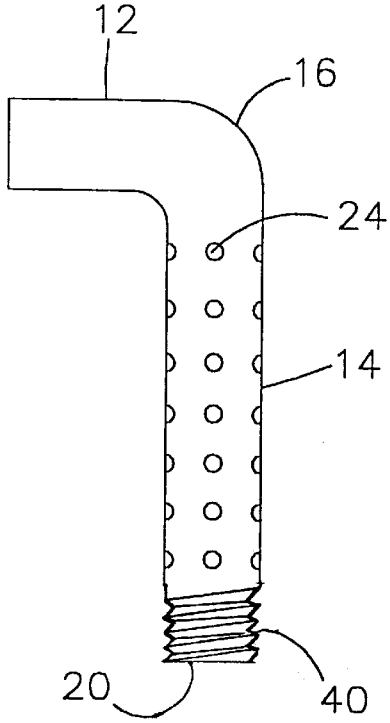
FIG. 12 is a side view of the device shown in FIG. 11.
Figure 14:
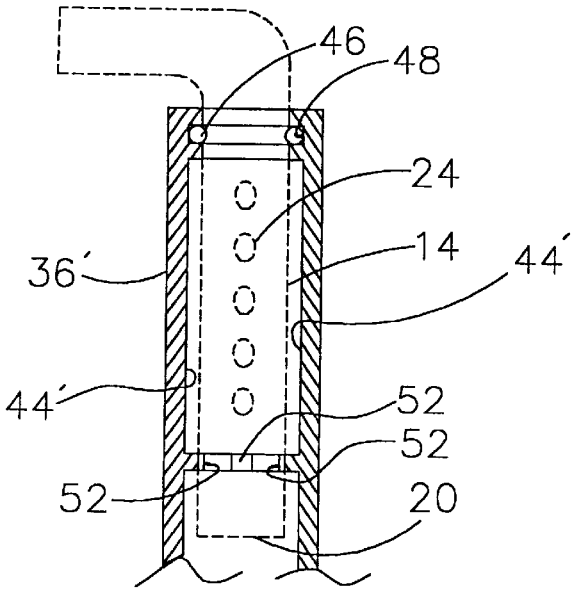
FIG. 14 is a sectional view of another embodiment of the connection device shown in FIG. 11.
Figure 13:
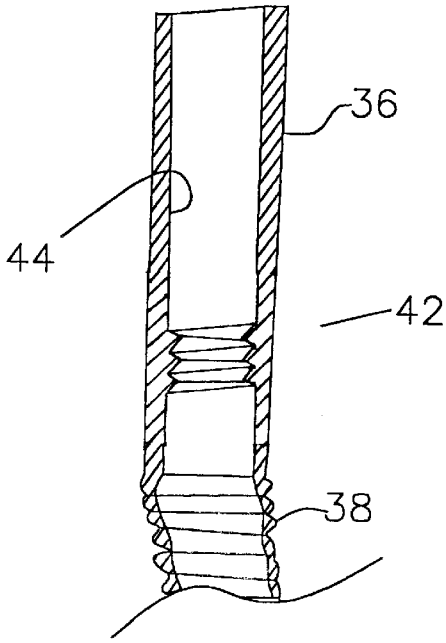
FIG. 13 is a sectional view of one embodiment of the connection device shown in FIG. 11.

Of course any appropriate type of connection can be used to connect the connection device 36 to the suction dispersion device, such as, for example, threads, a bayonet socket, a clamp or a friction fit. As an example, FIGS. 12 and 13 show threaded portion 40 of the suction dispersion device which engages threads 42 on the inside of connection device 36. In the example of FIGS. 12 and 13, periphery holes 24 are covered by the inside wall 44 of connection device 36 such that all of the suction is developed through the end hole 20. As another example, FIG. 14 shows a connection device 36' which includes an o-ring 46 located in a groove 48 at an upper end of the connection device 36'. The o-ring 46 creates a seal and a friction fit with the periphery surface 22 of the suction dispersion device when the connection device 36' is installed over the suction dispersion device. Suction is developed, and water flows, through the periphery holes 24 and the end hole 20 since the periphery surface 22 is held away from the inside wall 44' of the connection device 36' by the support members 52.

Various details of the invention may be changed without departing from its spirit or its scope. Furthermore, the foregoing description of the embodiments according to the present invention is provided for the purpose of illustration only, and not for the purpose of limiting the invention as defined by the appended claims and their equivalents.

What is claimed is:

1. A suction dispersion device for removably inserting into an underwater suction inlet located in a wall of a pool or spa, the suction dispersion device comprising:

a tubular body having a first tubular portion and a second tubular portion;

the first tubular portion having a sealing mechanism for forming a substantially water-tight seal with the suction inlet of the pool or spa when connected to the suction inlet of the pool or spa; and the second tubular portion having a submersible length with a tubular periphery and an end, the periphery and the end being perforated to disperse a suction force of the suction inlet along the submersible length of the second tubular portion.

2. The suction dispersion device of claim 1, wherein the tubular body further comprises an elbow such that the first tubular portion and the second tubular portion are positioned at approximately 90 degrees relative to each other.

3. The suction dispersion device of claim 1, wherein the second tubular portion is perforated with a plurality of holes.

4. The suction dispersion device of claim 3, wherein a first hole of the plurality of holes is on a first plane and a second hole of the plurality of holes is on a second plane different from the first plane.

5. The suction dispersion device of claim 4, wherein the first plane is substantially perpendicular to the second plane.

6. The suction dispersion device of claim 3, wherein the plurality of holes includes at least a first hole and a second hole, the first hole and the second hole being separated by a distance of at least 2½ inches.

7. The suction dispersion device of claim 6, wherein the first hole and the second hole are separated by a distance of at least 3 inches.

8. The suction dispersion device of claim 7, wherein the first hole and the second hole are separated by a distance of at least 4 inches.

9. The suction dispersion device of claim 1, wherein the end of the second tubular portion has an inside cross sectional area and is perforated with only one hole, the area of the one hole being substantially equal to the inside cross sectional area of the end of the second tubular portion.

10. The suction dispersion device of claim 1, wherein the sealing mechanism of the first tubular portion comprises a tube having an outside diameter substantially equal to an inside diameter of the suction inlet of the pool or spa.

11. The suction dispersion device of claim 1, wherein the end of the second tubular portion is covered by a cap, the cap being attached to the end of the second tubular portion such that fluid flow is permitted through at least one hole in the end of the second tubular portion.

12. The suction dispersion device of claim 1, further comprising an attachment portion connected to the tubular body, wherein the suction dispersion device can be attached to the pool or spa by the attachment portion.

13. The suction dispersion device of claim 1, further comprising a connection device mounted on the tubular body, the connection device being capable of releasably connecting a conduit to the tubular body for covering at least one of the perforations in the periphery of the second tubular portion and covering the end of the second tubular portion such that the suction force is transferred from the suction inlet to the conduit through the perforated second tubular portion.

14. The suction dispersion device of claim 13, wherein the conduit is a flexible hose connected to a pool cleaning device.

15. A method of dispersing a suction force of an underwater suction inlet located in a wall of a pool or spa, comprising the steps of:

diverting a flow of fluid sucked into the suction inlet by the suction force, the flow being diverted by a tubular diverter removably inserted into the suction inlet; and dispersing the suction force by drawing the flow into the diverter through a plurality of holes in the diverter, a first hole of the plurality of holes being on a first plane, a second hole of the plurality of holes being on a second plane different from the first plane and a third hole of the plurality of holes being on a third plane substantially perpendicular to the first and second planes.

16. A suction dispersion device for use with an underwater suction inlet of a pool or spa, the suction dispersion device comprising:

a tubular body having a first tubular portion and a second tubular portion;

the first tubular portion having a sealing mechanism for forming a substantially water-tight seal with the suction inlet of the pool or spa when connected to the suction inlet of the pool or spa, the sealing mechanism having a flexible adapter with at least one flexible fin protruding radially from the first tubular portion; and the second tubular portion having a submersible length with a tubular periphery and an end, the periphery and the end being perforated to disperse a suction force of the suction inlet along the submersible length of the second tubular portion.

17. The suction dispersion device of claim 16, wherein a plurality of flexible fins protrude radially from the first tubular portion and are arranged along an axis of the first tubular portion, the plurality of flexible fins increasing in size in a direction from the suction inlet toward the second tubular portion.

18. The suction dispersion device of claim 1, further comprising a connection device mounted on the tubular body, the connection device being capable of releasably connecting a conduit to the tubular body for covering substantially all of the perforations in the periphery of the second tubular portion and covering the end of the second tubular portion such that the suction force is transferred from the suction inlet to the conduit through the perforated second tubular portion.

* * * * *